US005294192A

United States Patent [19]

Omdoll et al.

[11] Patent Number: 5,294,192

[45] Date of Patent: Mar. 15, 1994

[54] DISPENSER FOR ROLLED SHEET MATERIAL

[75] Inventors: Paul A. Omdoll, Waukesha; Scott J. Collins, Brown Deer, both of Wis.

[73] Assignee: San Jamar, Inc., Elkhorn, Wis.

[21] Appl. No.: 74,170

[22] Filed: Jun. 9, 1993

Related U.S. Application Data

[63] Continuation of Ser. No. 668,247, Mar. 12, 1991, abandoned.

[51] Int. Cl.[5] ..... B65H 16/00

[52] U.S. Cl. ..... 312/34.22; 242/55.2

[58] Field of Search ..... 312/34.22, 34.8; 242/55.2, 55.53

[56] References Cited

U.S. PATENT DOCUMENTS

| | | | |
|---|---|---|---|
| 3,917,191 | 11/1975 | Graham | 242/55.3 |
| 4,010,909 | 3/1977 | Bastian | 242/55.3 |
| 4,165,138 | 8/1979 | Hedge et al. | 312/39 |

*Primary Examiner*—Kenneth J. Dorner
*Assistant Examiner*—Gerald A. Anderson
*Attorney, Agent, or Firm*—Michael, Best and Friedrich

[57] ABSTRACT

A device for dispensing flexible sheet material, such as paper toweling, from a roll has a feed mechanism including a crank- or lever-operated roller having a drive section and a pressure element engageable with toweling extending around a portion of the roller. The pressure element is spring-biased toward the outer surface of the roller drive section and provides sufficient friction between the roller drive section and the toweling to cause it to be unwound from a roll and advanced for dispensing with out the need for an idler roller which can cause jamming. In one embodiment, a transfer assembly is provided for sequentially dispensing toweling from a primary roll and a reserve roll, after all the toweling has been dispensed from the primary roll. The transfer assembly is mounted for movement between a non-transfer position, where a sensing arm is biased into engagement with the outer surface of toweling on the primary roll to effectively sense the thickness of both the toweling on and the roll core of the primary roll and a pair of transfer legs on a transfer arm are spaced outwardly from the outer surface of the roller, and a transfer position, where the sensing arm engages the outer surface of the primary roll core and the transfer legs push toweling from the reserve roll against the outer surface of the roller and cause it to be fed between the dispensing surface of the pressure element and the roller drive section.

25 Claims, 7 Drawing Sheets

DISPENSER FOR ROLLED SHEET MATERIAL

This application is a continuation of U.S. patent application Ser. No. 07/688,247 filed Mar. 12, 1991 now abandoned.

BACKGROUND OF THE INVENTION

This invention relates to dispensers for rolled sheet material and, in one aspect, to dispensers for paper towel rolls.

Dispensers for rolls of flexible sheet material, such as paper towel rolls, are well known. Paper towel dispensers are widely used in public lavatories to dispense paper toweling for users to dry their hands. Such dispensers typically include either a crank or lever which a user operates to drive a feed mechanism for dispensing the paper toweling. The feed mechanism typically includes a drive roller rotated by a crank or lever and an idler roller, the paper toweling is threaded between these two rollers and the idler roller is spring loaded to provide sufficient friction for rotation of the drive roller to unwind the paper toweling off a roll core. There usually is a relatively small clearance between the drive and idler rollers and the paper toweling can become backed up and cause jamming.

Some paper towel dispensing devices are capable of sequentially dispensing two rolls of paper toweling. This type dispenser is arranged so that, when all the paper toweling from a primary roll has been dispensed, the feed mechanism starts dispensing paper toweling from a reserve roll. Some multiple-roll dispensers have a transfer mechanism including a number of rollers which are arranged to provide tension between the paper toweling being unwound from the primary roll and the feed mechanism and, in response to loss of this tension, effect a transfer of paper toweling from the reserve roll into the feed mechanism. This loss of tension usually occurs when the tail end of the paper toweling has been completely unwound and detached from the primary roll core. However, a loss of tension occasionally can occur during normal use even though there still is paper on the primary roll. For example, if the primary roll core binds and the user is required to use additional force to operate the crank or lever, the primary roll can overrun after the bind is broken loose. This can cause a slack condition which is the same as a loss of tension to the transfer mechanism and it then makes a false transfer, causing paper toweling from the reserve roll to be introduced into the feed mechanism. When this occurs, the feed mechanism can become jammed and no longer capable of dispensing paper toweling or to simultaneously dispense paper toweling from both the primary and reserve rolls.

Some prior constructions which employ a series of rollers for making a transfer from the primary roll to the reserve roll are vulnerable to not effecting a transfer under some conditions which can occur during normal use. Many prior constructions are designed to dispense only one size roll; others are sensitive to the thickness and/or type of the paper toweling being dispensed; others are limited with respect to the size of paper towel roll and/or the roll core size.

Various attempts have been made to minimize a false transfer. For example, U.S. Hedge et al. Pat. No. 4,165,138 discloses a transfer assembly which does not rely on sensing a loss of tension to trigger a transfer. However, the transfer assembly includes two or more rollers with the attendant shortcomings and a number of other parts which increase the overall complexity and cost of construction.

SUMMARY OF THE INVENTION

An object of the invention is to provide a simply constructed device for dispensing flexible sheet material from a roll, particularly paper toweling, including a feed mechanism which does not include an idler roller or similar component which contacts a substantial portion of a drive roller.

Another object of the invention is to provide such a dispenser for paper toweling including a transfer assembly for reliably effecting sequential dispensing of toweling from a first or primary roll and then from a second or reserve roll after all the toweling has been dispensed from the first or primary roll.

A further object of the invention is to provide such a paper towel dispenser which is capable of dispensing a wide variety of roll sizes, roll core sizes and types of paper.

A still further object of the invention is to provide a dispenser for paper toweling which is arranged to permit convenient interchangeable assembly for either crank or lever operation or for either dispensing from a single roll or automatic sequential dispensing from a primary roll and a reserve roll.

Other objects, aspects and advantages of the invention will become apparent to those skilled in the art upon reviewing the following detailed description, the drawings and the appended claims.

The invention provides a device for dispensing flexible sheet material, such as paper toweling, from a roll. The device has a feed mechanism including a roller having a drive section and a pressure element extending toward the roller drive section and having a dispensing surface engageable with sheet material extending around a portion of the roller. The pressure element is biased toward the roller drive section so that, when material extends between the dispensing surface of the pressure element and the roller drive section, the outer surface of the roller drive section is in sufficient frictional engagement with the material to cause it to be unwound from a roll and dispensed in response to rotation of the roller. The pressure element preferably is pivotally mounted for reciprocative movement of the dispensing surface toward and away from the outer surface of the roller drive section and is biased toward that surface by a spring arrangement which can be adjusted to vary the tension or amount of drive applied to the material being dispensed.

In one embodiment, the device is arranged to sequentially dispense material from a first or primary roll and a second or reserve roll and includes a transfer assembly for automatically transferring material from the reserve roll to the feed mechanism when at least substantially all the material has been dispensed from the primary roll. The transfer assembly includes means for sensing the thickness of both the material on the primary roll and the roll core therefor and shifting means for transferring material from the reserve roll to between the dispensing surface of the pressure element and the outer surface of the roller drive section in response to the sensing means sensing a thickness corresponding to that of the primary roll core.

In a preferred embodiment, the transfer assembly includes a transfer arm having a pair of legs axially spaced relative to the roller and engageable with the material extending around a portion of the roller at locations on the opposite sides of the pressure element and a sensing arm having a sensing surface engageable with the outer surface of material on the primary roll and the roll core therefor. The transfer assembly is mounted for common movement of the transfer and sensing arms between a non-transfer position where the sensing surface engages the outer surface of material on the primary roll and the transfer surfaces of the transfer arm legs are spaced away from the outer surface of the roller and a transfer position where the sensing surface engages the outer surface of the primary roll core, after at least substantially all the material has been dispensed from the primary roll, and the transfer arms push material from the reserve roll into engagement with the outer surface of the roller and, in response to rotation of the roller, causes the material from the reserve roll to be fed between the dispensing surface of the pressure element and the drive section of the roller and advanced to a dispensing location.

DESCRIPTION OF THE PREFERRED EMBODIMENT

While the dispensing device provided by the invention can be adapted to dispense a variety of rolled flexible sheet materials, it is particularly adaptable for dispensing paper towel rolls and will be described in connection with that application.

Figure 1:
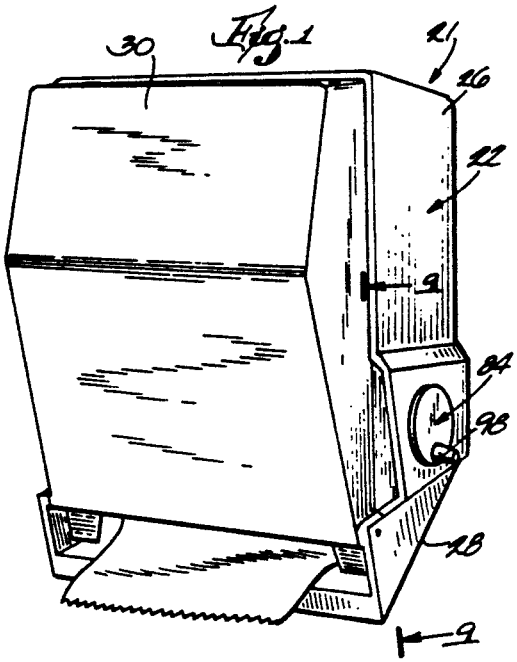
FIG. 1 is a perspective view of a paper towel dispensing cabinet embodying the invention and including a crank unit for dispensing toweling.
Figure 4:
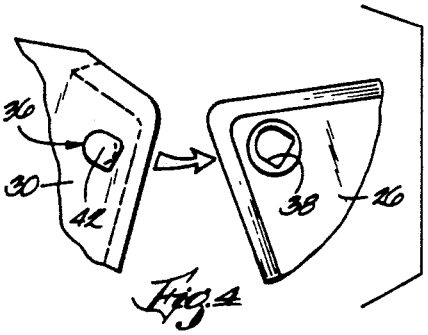
FIGS. 4–8 are enlarged, fragmentary views of the pivot connection of the cover to the sides of the cabinet.
Figure 2:
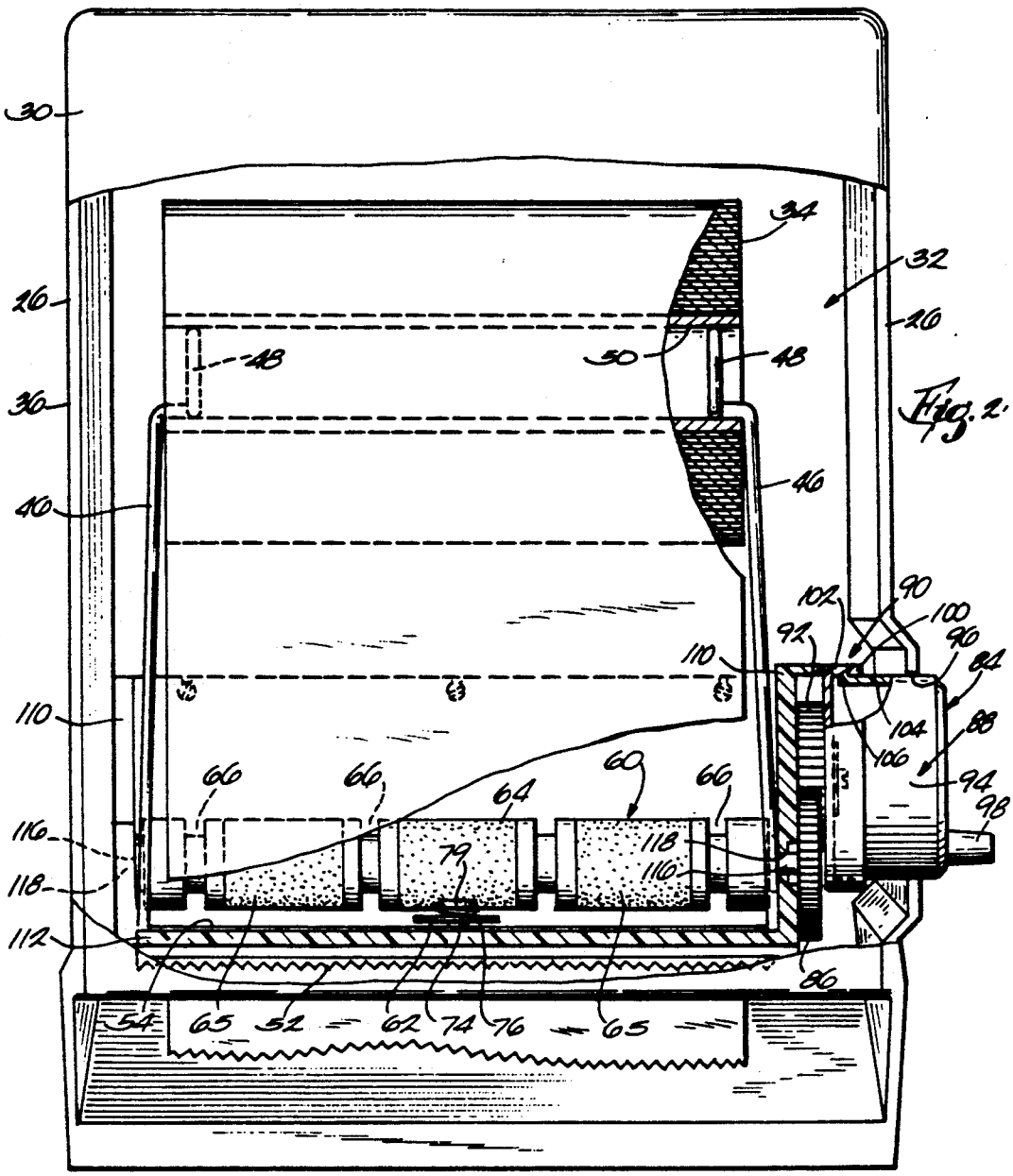
FIG. 2 a partially broken away, front elevational view of the dispensing cabinet illustrated in FIG. 1, shown in a configuration for dispensing toweling from a single roll.
Figure 3:
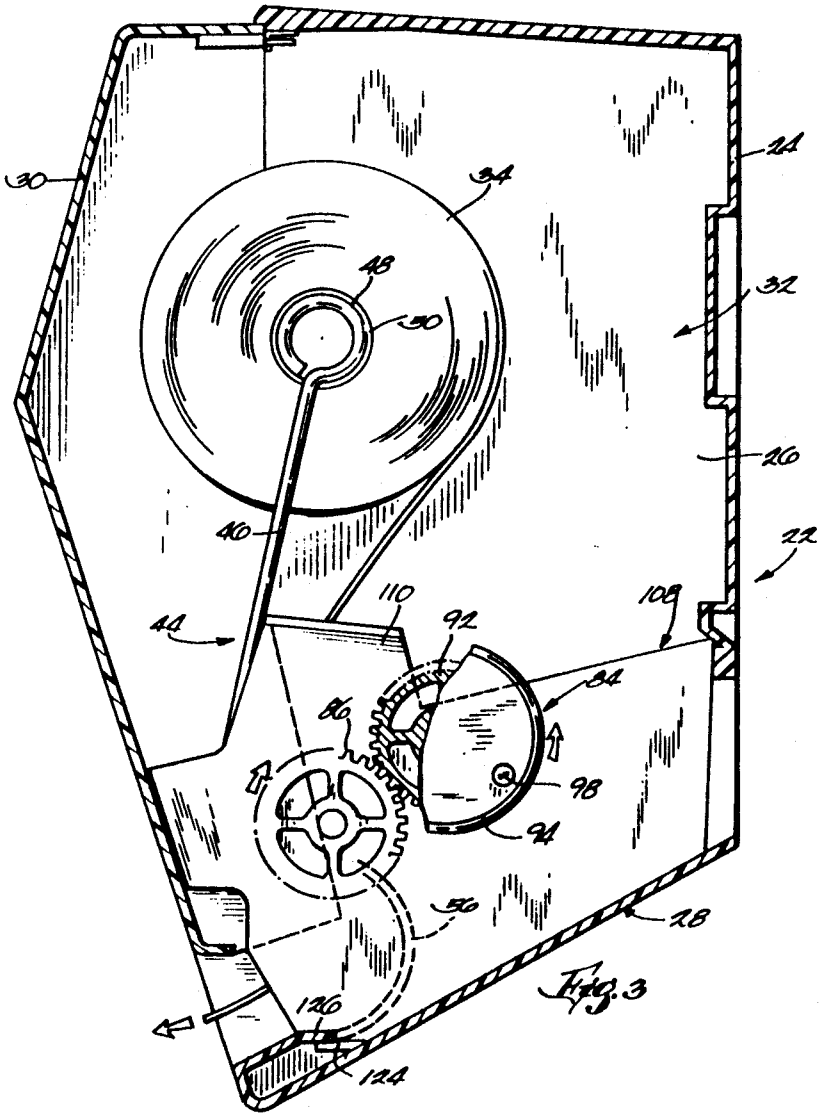
FIG. 3 is a partially broken away, side elevational view of the dispensing cabinet illustrated in FIGS. 1 and 2.

FIGS. 1–3 illustrate a paper towel dispensing device including a cabinet 22 having a back wall 24, opposed side walls 26, a bottom wall 28 and a cover 30 which cooperate to define a storage compartment 32 for a roll of paper toweling 34. The cover 30 is pivotally connected to the cabinet side walls 26 by hinge or pivot pins 36 and can be swung downwardly to an open position to gain access to the storage compartment 32 or swung upwardly to a closed position and locked in place with a suitable lock (not shown).

Figure 5:
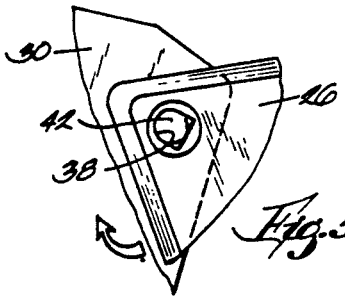
Figure 6:
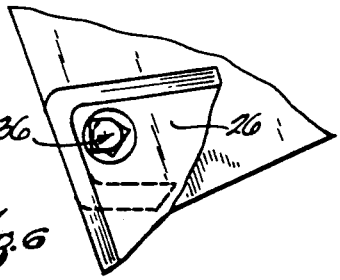
Figure 8:
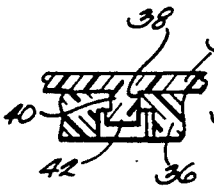
Figure 7:
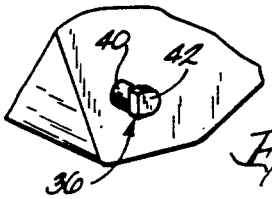

Referring to FIGS. 4–8, each cabinet side wall 26 has a D-shaped aperture 38 and each cover pivot pin 36 has shank portion 40 and a D-shaped outer end portion 42 which fits through an aperture 38 when the cover 30 is in about a fully down position shown in FIG. 5. After the end portions 42 of the pivot pins 36 are inserted through the apertures 38 and the cover 30 swung upwardly toward the position illustrated in FIG. 6, the pivot pins 36 are locked in place. The cover 30 can be removed only by swinging it down to a position where the outer end portions 42 of the pivot pins 36 are aligned with the apertures 38 (FIG. 5) and then outwardly flexing the cabinet side walls 26. Thus, the cover 30 can be conveniently removed and replaced in the field without any tools.

A paper towel roll 34 is supported on a bent wire holder 44 including a cross member (not shown) rotatably supported from the cabinet 22 and a pair of upwardly extending arms 46 having circular ends 48 for rotatably receiving the opposite ends of the roll core 50. With the cover 30 in an open position, a paper towel roll 34 can be installed by rotating the arms 46 of the holder 44 forwardly to a loading position (counterclockwise as viewed in FIG. 3), spreading the arms 46 far enough apart for insertion of the circular ends 48 into the opposite ends of the roll core 50 and the swinging to arms 46 back to the operating position illustrated in FIG. 3.

Paper toweling is dispensed from the cabinet 22 through a dispensing passage or opening 51 defined between the cutting edge 52 of a cut off member or blade 54 extending transversely relative to the cabinet side walls 26 and a curvilinear wall 56 extending upwardly from the cabinet bottom wall 28. The cut off blade 54 preferably is metal and the cutting edge 52 has serrations or teeth so that paper toweling extending through the dispenser opening 51 can be severed by pulling upwardly.

The feed mechanism for dispensing paper toweling (FIGS. 2, 9 and 10) includes a roller 60 and a pressure element or finger 62. The roller 60 extends transversely with respect to and is supported from the cabinet side walls 26 for rotation about an axis generally parallel to the rotational axis of the paper towel roll 34. The roller 60 includes a primary drive section or ring 64 made from a suitable friction material, such as rubber having a Durometer of about 60–80. While various suitable arrangements can be used, in the preferred construction illustrated, the roller 60 has a centrally located primary drive ring 64 and a pair of auxiliary drive rings 65 axially spaced for the opposite sides of the primary drive ring 64. The auxiliary drive rings 65 provide additional frictional area contact with the surface of the paper toweling for dispensing as described below. They also assist in keeping the toweling straight on the roller 60. As is the usual practice, the roller 60 can have a plurality of axially spaced, circumferentially extending recesses 66.

The upper edge of the currilinear cabinet wall 51 is located adjacent the outer surface of the roller 60 and cooperates with axially spaced ribs 67 on the wall 56 and extending into the roller recesses 66 to guide toweling off the roller 60 and through the dispensing opening 51.

Figure 9:
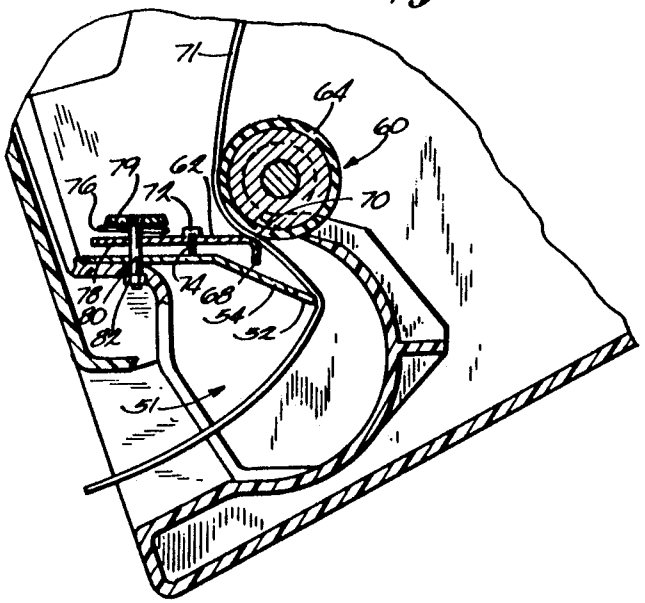
FIG. 9 is a partial, cross-sectional view taken generally along line 9—9 in FIG. 1, showing the toweling ready for dispensing.
Figure 10:
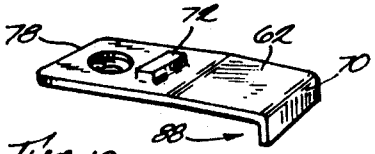
FIG. 10 is an enlarged, perspective view of the pressure finger or element for the feed mechanism.

The pressure finger 62 extends toward the primary drive ring 64 and has a downturned inner end portion 68 forming a dispensing surface 70 which extends generally parallel to the rotational axis of the roller 60 and is engageable with paper toweling 71 extending over a portion of the roller 60 as best illustrated in FIG. 9.

Biasing means is provided for urging the dispensing surface 70 toward the primary drive ring 64 so that, when toweling extends between the dispensing surface 70 and the primary drive ring 64, the outer surfaces of the primary drive ring 64 and the auxiliary drive rings 65 are in sufficient frictional engagement with the toweling to cause it to be unwound and dispensed through the dispensing opening 51 when the roller 60 is rotated in one direction, i.e. in the counterclockwise direction as viewed in FIG. 9. While other suitable arrangements can be used, in the preferred construction illustrated, the pressure finger 62 has a recessed portion 72 which is located at about the midpoint and loosely fits over and is pivotal on the upper end of upright, generally rectangular post 74. The post 74 acts as a fulcrum for the pressure finger 62 so it can pivot or rock up and down to move the dispensing surface 70 toward and away from the outer surface of the primary drive ring 64.

The dispensing surface 70 is biased toward engagement with the primary drive ring 64 by a tension spring 76 bearing against the outer end portion 78 of the pressure finger 62. The spring 76 is held in place by a spring keeper 79 which is retained by a bolt 80 and nut 82 so that the tension applied by the dispensing surface 70 can be adjusted by turning the bolt 80. As viewed in FIG. 9, clockwise rotation of the tension-adjusting bolt 80 increases tension and counterclockwise rotation reduces tension. The tension-adjusting bolt 80 preferably has a slotted head so that the spring tension and the amount of drive can be conveniently adjusted with a screw driver.

In the embodiment illustrated in FIGS. 1–11, the roller 60 is rotated by a crank assembly 84 (FIGS. 2, 3 and 11) including a gear 86 operably connected to one end of the roller 60 via a conventional one-way clutch (not shown) so that the roller 60 can be rotated only in a direction for dispensing toweling from the cabinet 22 and not in a reverse feeding direction. The roller gear 86 is driven by a crank unit 88 including a rotatably mounted inner part 90 located inside the cabinet 22 and having a drive gear 92 which meshes with the roller gear 86. The crank unit 88 also includes an outer part 94 extending through an opening 96 in one of the cabinet side walls 26 and having a crank handle 98 for rotating the crank unit 88 in a clockwise direction as viewed in FIG. 9.

Figure 11:
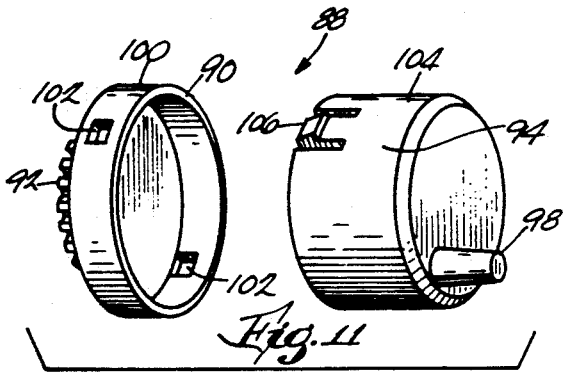
FIG. 11 is an exploded, perspective view of some of the components making up a crank unit for dispensing toweling.

As best shown in FIG. 11, the inner part 90 is a one-piece unit. It has a cup-like shape and an outwardly extending, circular, peripheral flange 100 including a pair of diametrically opposed notches 102 and the drive gear 92 is formed as an integral part thereof. The outer part 94 also has a cup-like shape and is a one-piece unit with the handle 98 formed as an integral part thereof. The outer part 94 has an inwardly extending, circular peripheral flange 104 including a pair of diametrically opposed, resilient fingers 106 which register with and snap into the inner part notches 102 to complete assembly of the crank unit 88.

To start dispensing, toweling 71 is pulled from the roll 34 and laid against the front surface of the roller 60. While the crank unit 88 is being rotated in the clockwise direction, an attendant pushes the toweling against the roller 60 with his or her fingers on the opposite sides of the pressure finger 62 to feed it between the roller drive ring 64 and the dispensing surface 70 of the pressure finger 62.

The tension and amount of drive on the toweling 71 can be adjusted to accommodate different type papers and/or paper thicknesses by rotating the tension-adjusting bolt 80 on the pressure finger 62 as described above. The relatively small contact area between the dispensing surface 70 or the pressure finger 62 and the toweling 71 minimizes jamming. The additional frictional engagement provided by the auxiliary drive rollers 65 assists in clearing jamming.

Figure 13:
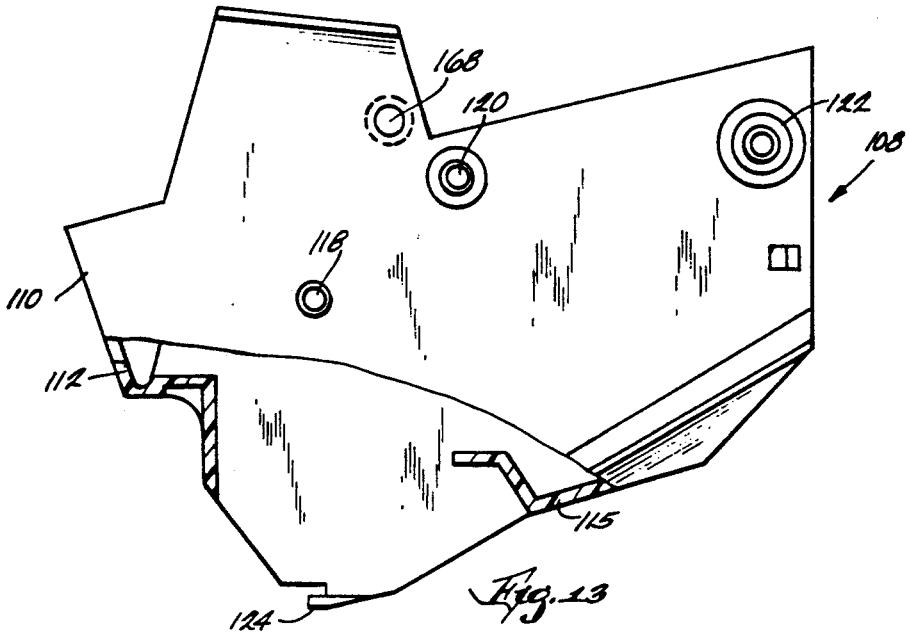
FIG. 13 is a partially sectioned, side elevational view of the carriage illustrated in FIG. 12.
Figure 12:
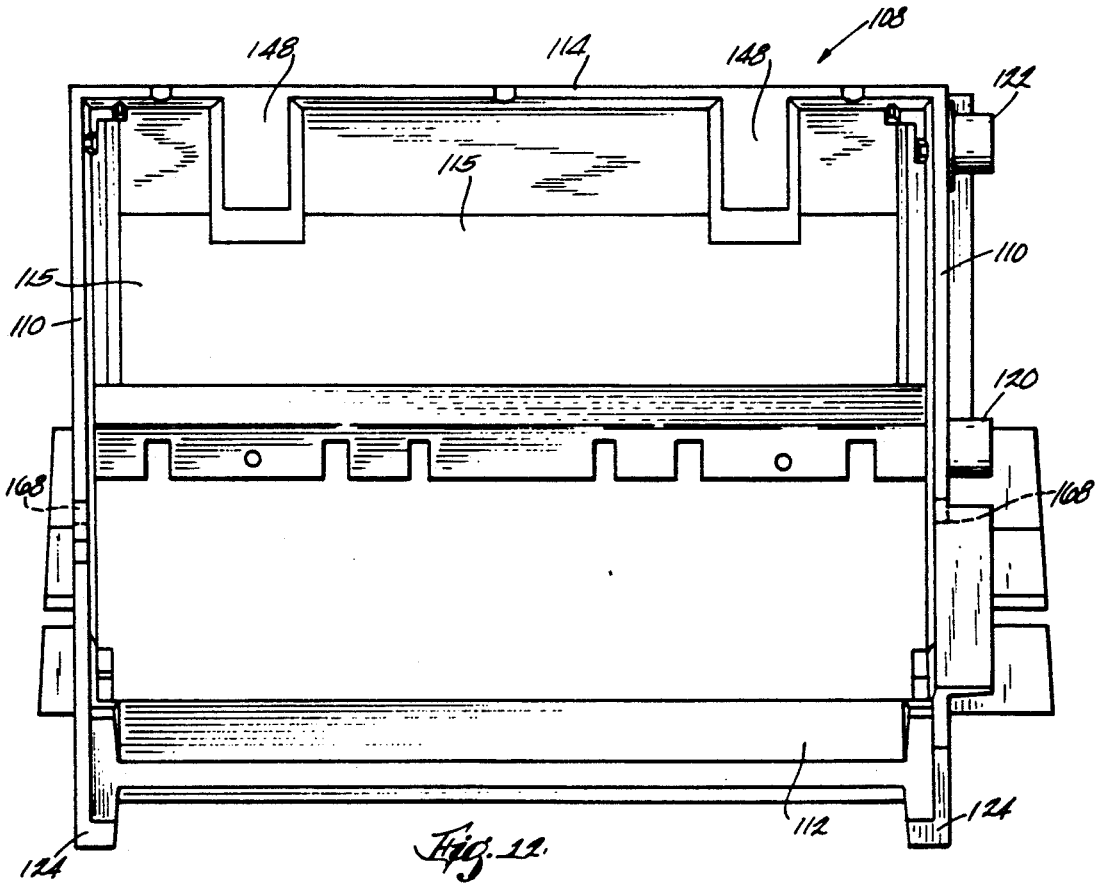
FIG. 12 is a top plan view of a carriage for supporting certain components of the device.
Figure 16:
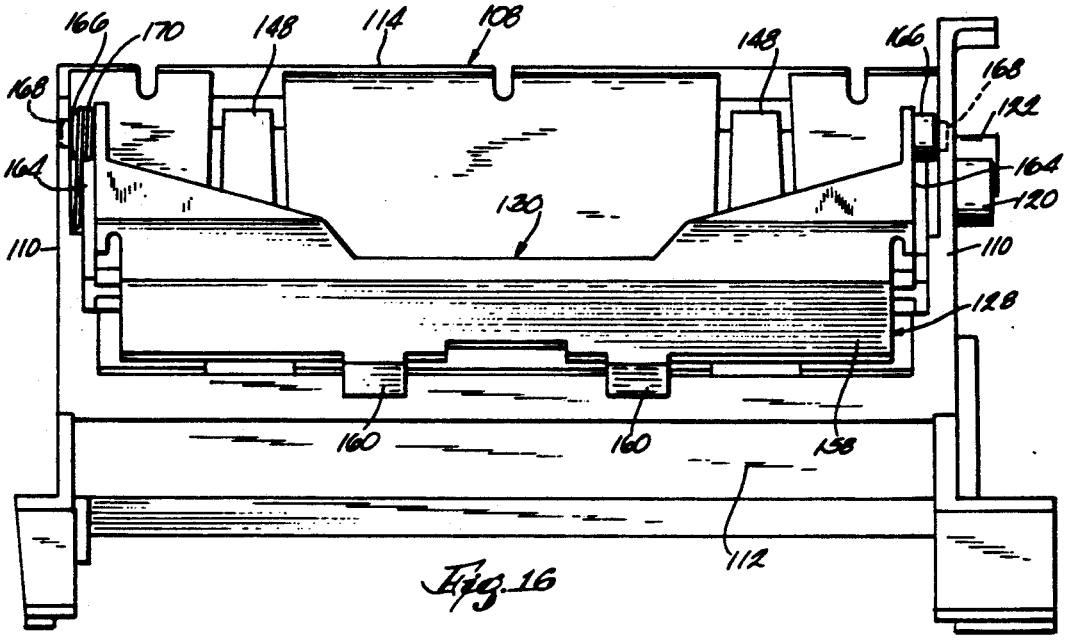
FIG. 16 is a front elevational view of the carriage and transfer assembly roll, illustrated in FIG. 15.
Figure 15:
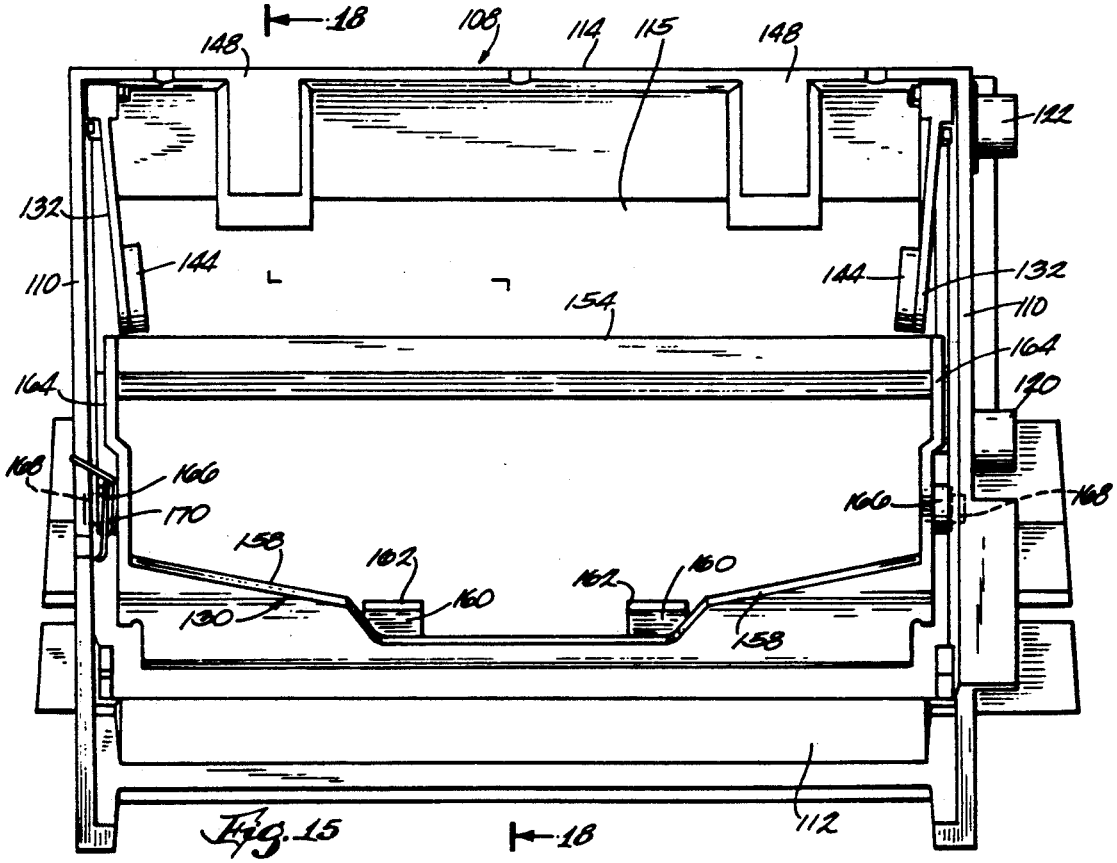
FIG. 15 is a top plan view of a carriage including a transfer assembly for automatically dispensing from a primary roll to a reserve shown with certain parts removed.

In the preferred construction illustrated, the roller 60, the pressure finger 62, the cut off blade 64, the roller gear 86 and the inner part 90 of the crank unit 88 are mounted on a separate chassis or carriage 108 (FIGS. 12 and 13) to form a self-contained drive module which fits into and is removably mounted on the cabinet 22. The carriage 108 preferably is a one-piece unit and has opposed side frame members 110 which extend adjacent the cabinet side walls 26, a front frame member 112 extending between and connected to the side frame members 110, a rear frame member 114 extending between and connected to the side frame members 110 and a bottom wall 115 which in conjunction with the curvilinear wall 56 forms the bottom wall 28 of the cabinet 22. The preferred one-piece construction of the carriage 108 minimizes a build up of manufacturing tolerances which can occur when the various components making up the drive module are supported on a number of different parts.

Prior to installation of the carriage 108 into the cabinet 22, the roller 60 is installed by inserting stub shafts 116 thereon into apertures 118 in the carriage side frame members 110. The cut off blade 54, pressure finger 62, and the cross member of the roll holder 44 are mounted on the front frame member 112. The carriage 108 can be designed so that the dispenser can be used interchangeably as a single or double roll dispenser and operated with either a crank or lever. To accommodate this interchangeability, one side frame member 110 (FIGS. 12 and 13) includes a boss 120 for rotatably receiving the inner part 90 of the crank unit 88 and a boss 122 for rotatably receiving one end of the operating lever as described below.

When a crank assembly 84 is used as illustrated in FIGS. 1–3, the roller gear 86 is mounted on one shaft stub 116 extending through a carriage side wall aperture 118 and the crank unit inner part 90 is mounted on the boss 120 and secured thereto, such as with a washer and screw (not shown), to capture the roller gear 86.

The drive module is installed by tipping the carriage 108 up, placing tabs 124 on the front lower edges of the side frame members 110 under projections 126 in the lower front part of the cabinet 22 and then tipping the rear portion of the carriage 108 down into place inside the cabinet 22 behind the curvilinear wall 56. The carriage 108 is secured with a plurality of screws (not screws) extending through the carriage rear frame member 114 and threaded into the cabinet back wall 24. Assembly is completed by snapping the outer part 94 of the crank unit 88 into place inside the inner part 90 and installing the cover 30 as described above.

FIGS. 14–21 illustrate a two-roll dispenser for sequentially dispensing toweling from a primary roll P and a reserve roll R (same as roll 34 in FIGS. 2 and 3) and operated with a lever. Components common with those for the embodiment described above are designated with common reference numerals.

Figure 19:
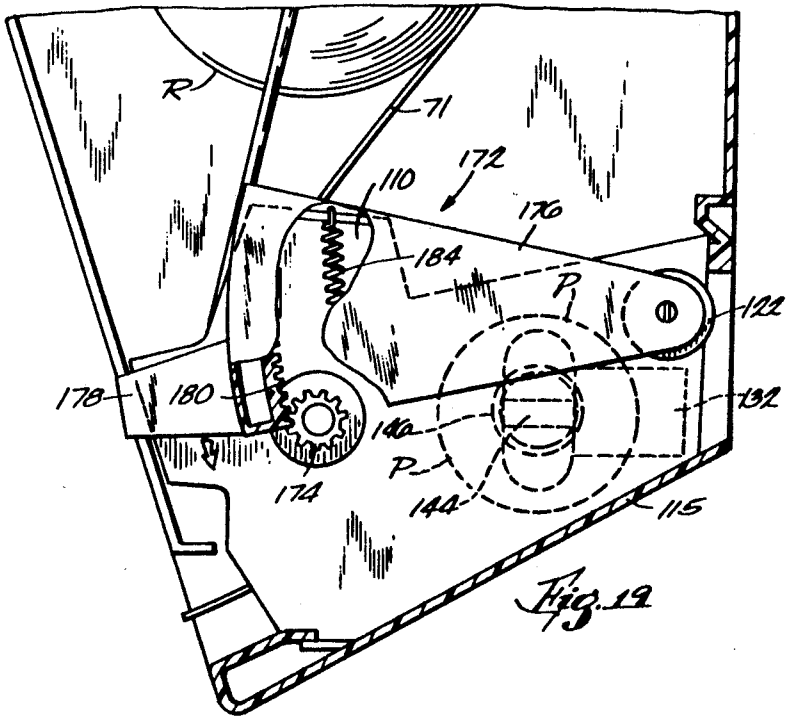
FIG. 19 is a fragmentary, partially broken away and partially sectioned view of the dispensing cabinet illustrated in FIG. 14.

The two-roll dispenser 128 includes (FIGS. 15 and 16) a transfer assembly 130 and a pair of ears 132 for holding the primary roll P in the rear portion of the carriage 108. One end of the ears 132 snaps into a small apertures in the carriage side frame members 110 and are locked in place. The opposite ends of the ears 132 are free to permit flexing for installation of a paper towel roll therebetween. Each ear 132 includes an inwardly extending boss 144 for rotatably receiving the opposite ends of the primary roll core 146 (FIG. 19). The bosses 144 are sized so that the roll core 146 is free to float thereon and rotate about an axis generally parallel to the rotational axis of the roller 60. Such an arrangement facilitates use of different size roll cores.

In addition to the ears 130 for supporting the primary roll P, the rear portion of the carriage 108 is arranged to define a well for receiving and retaining the primary roll P. The carriage bottom wall 115 is shaped to form a trough-like pocket. This well and the ears 132 are dimensioned to accommodate paper towel rolls ranging from 4-inch diameter or smaller up to 8-inch diameter or larger. Thus, the dispenser is universal in that it is capable of accommodating all present paper manufacturers' rolls. A pair of ribs 148 projecting inwardly from the carriage rear frame member 14 are provided to prevent rolls larger than a predetermined maximum size from being forced into the well.

The transfer assembly 130 is designed to transfer toweling 150 from the reverse roll R to the feed mechanism in response to all the toweling being unwound from the primary roll P. More specifically, the transfer assembly 128 is designed to sense the thickness of both the toweling on the primary roll P and the roll core 146 for the primary roll P and transfer toweling 71 from the reverse roll R to between the dispensing surface 70 of the pressure finger 62 and the outer surface of the primary drive ring 64 when the sensed thickness corresponds to the thickness of the primary roll core 146.

In the preferred construction illustrated, the transfer assembly 130 is a one-piece unit and includes a transverse sensing arm 154 having a sensing surface 156 extending generally parallel to the rotational axis of the primary roll P and engageable with the outer surface of toweling on the primary roll P and the outer surface of the roll core 146 for the primary roll P. The transfer assembly 130 also includes a transverse transfer arm 158 having a pair of axially spaced, downward extending transfer legs or fingers 160, each including a transfer surface 162, and web sections 164 interconnecting the opposite ends of the sensing arm 154 and the transfer arm 158. The transfer fingers 160 are axially spaced to straddle the pressure finger 62 and so that the transfer surfaces 162 are engageable with the surface of the roller 60 on the opposite sides of the primary drive ring 64.

Each web section 164 includes a boss 166 which fits into respective apertures 168 in the carriage side frame members 110 for pivotal movement of the transfer assembly 130 between non-transfer and transfer positions as described in more detail below. A spiral spring 170 anchored between one of the web sections 164 and the corresponding carriage side frame member 110 urges the transfer assembly 130 in a counterclockwise direction as viewed in FIGS. 20 and 21.

Figure 20:
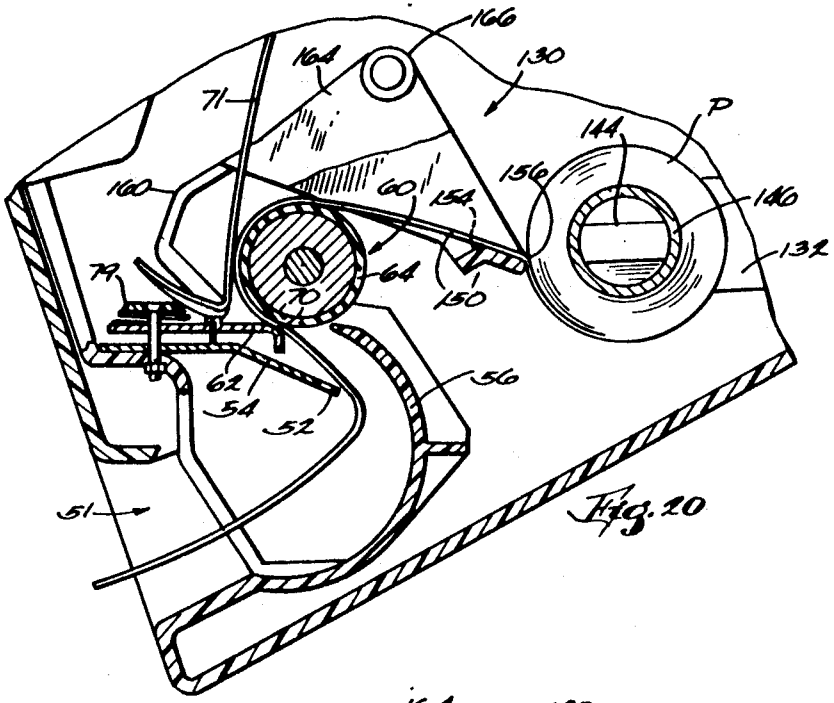
FIG. 20 an enlarged, fragmentary and sectional view showing the transfer assembly in a non-transfer position which paper toweling is being dispensed from the primary roll.

When a primary roll P is in place as illustrated in FIG. 20, the transfer assembly 130 is in a non-transfer position where the transfer fingers 160 are spaced some distance away from the outer surface of the roller 60 and the spiral spring 170 urges the sensing surface 156 of the sensing arm 154 against the outer surface of the toweling 150 on the primary roll P. It also urges the primary roll core 146 upwardly and rearwardly against the front portion of the ear bosses 144. This insures that the sensing arm 154 is effectively sensing the thickness or the layers of toweling on the primary roll P and also the thickness of the primary roll core 146 and thereby affords the capability of sensing different size rolls and roll cores without any modification or adjustment of the transfer assembly 130.

Figure 21:
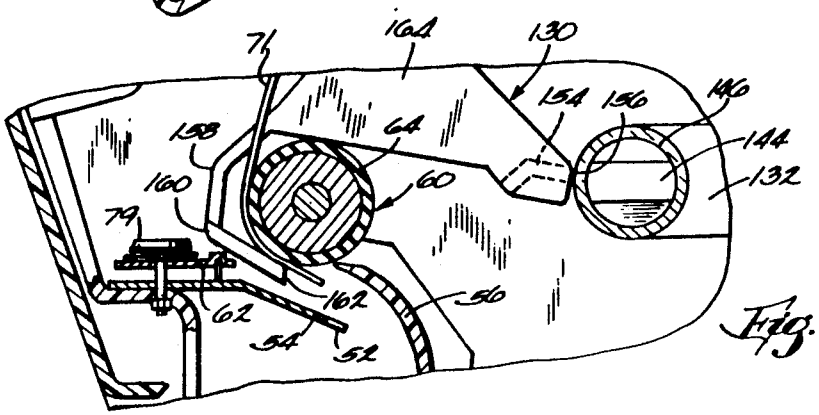
FIG. 21 is a view similar to FIG. 20 showing the transfer assembly in a transfer position after all the paper toweling has been removed from the primary roll and paper toweling is being dispensed from the reserve roll.

As the toweling 150 is unwound from the primary roll P, the transfer fingers 160 slowly rotate in a counterclockwise direction as viewed in FIGS. 20 and 21 and move closer to the outer surface of the roller 60. By the time all the toweling 150 has been unwound from the primary roll P and the sensing surface 156 is engaging the outer surface of the roll core 146 as illustrated in FIG. 21, the transfer assembly 130 has moved to a transfer position. When in this position, the transfer fingers 160 effectively push and tuck the toweling 71 from the reserve roll R against the outer surface of the primary roller ring 64 and, in response to rotation of the roller 60, cause it to be fed between the dispensing surface 70 of the pressure finger 62 and the primary drive ring 64. Thus, the transfer fingers 160 act much like an attendant's finger when making a manual feed as described above.

As shown in FIG. 20, the toweling 150 from the primary roll P rides over the top surface 171 of the sensing arm 154 and is maintained taunt by the sensing arm 154 in combination with the friction applied on the toweling by the primary drive ring 64 and the auxiliary drive rollers 65. Each time the roller 60 is rotated to dispense toweling 150 from the primary roll P, the toweling applies a downward force on the sensing arm 154 which causes the transfer assembly 130 to rotate clockwise as viewed in FIG. 20 and move the transfer fingers 160 away from the roller 60; actually away from contact with the toweling 71 from the reserve roll R. That action prevents the transfer fingers 160 from engaging the toweling from the reserve roll R with sufficient force to cause toweling to be dispensed from both the primary and reserve rolls at the same time. Also, that action prevents the transfer fingers 160 from effecting a transfer to the reserve roll until all the toweling has been removed from the primary roll. That is, as long as there is toweling on the primary roll, the transfer fingers 160 continue to be moved away from contact with toweling from the primary roll each time towel is dispensed. Once all the toweling has been removed from the primary roll P, the combined frictional engagement of the primary drive roller 64 and the auxiliary drive rollers 65 with the toweling 71 from the reserve roll causes toweling to be pulled from the reserve roll.

Figure 17:
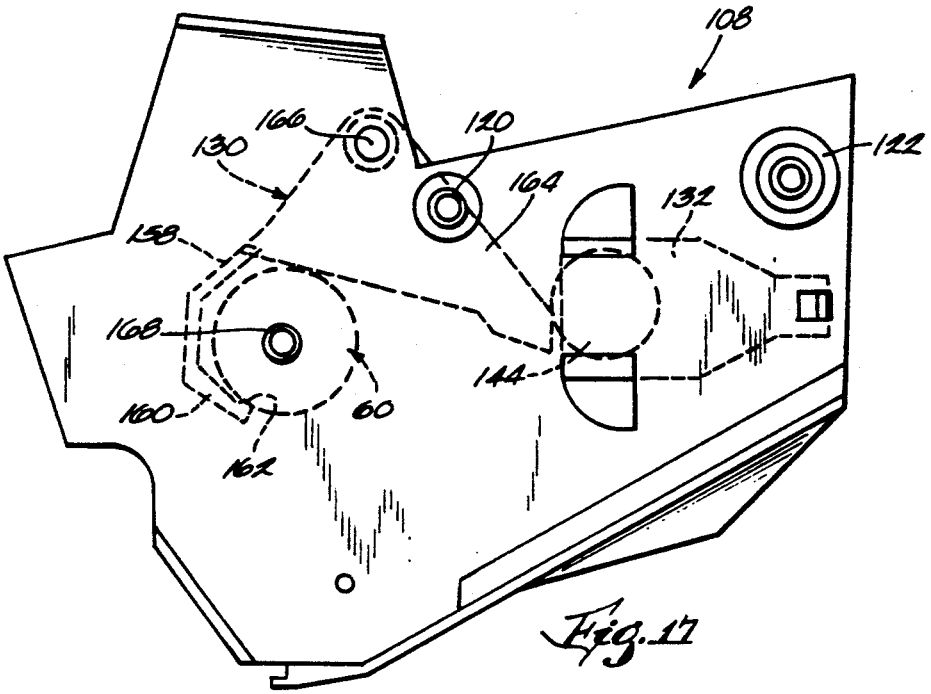
FIG. 17 is a side elevational view of the carriage and transfer assembly illustrated in FIG. 15.
Figure 18:
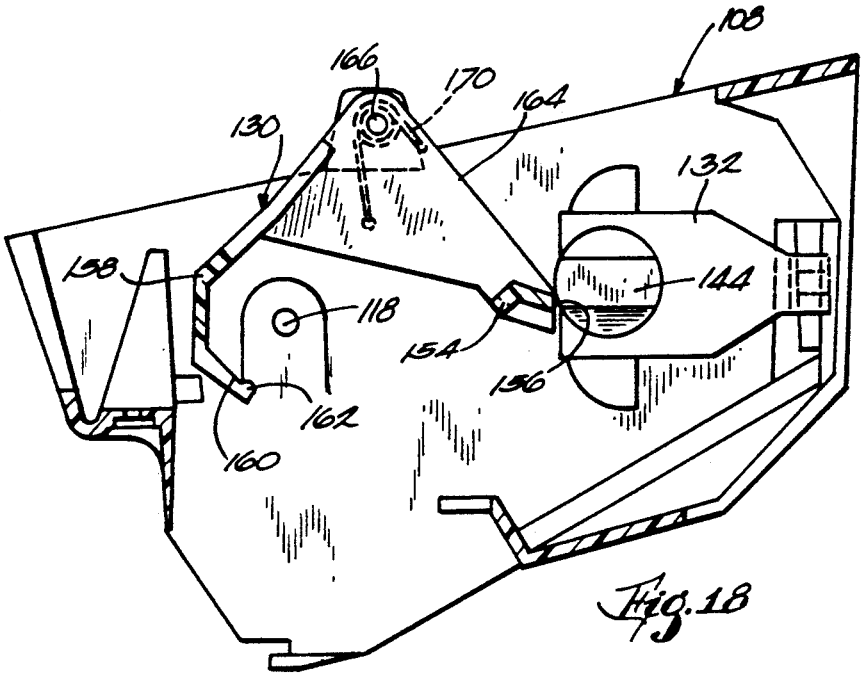
FIG. 18 is a cross-sectional view taken generally along line 18—18 on FIG. 15.

When a paper towel roll is not installed on the ears 132, the sensing arm 154 engages the front portions of the ears 132 to restrain further pivotal movement of the transfer assembly 130 as shown in FIGS. 17 and 18.

In a typical field situation, an attendant, noting that the primary roll P has been depleted, unlocks and opens the cover 30, removes the empty primary roll core 146 from the ears 132, removes the reserve roll R from the holder 44 and, with the loose end of the toweling 71 still threaded between the pressure finger 62 and the roller ring 64, installs the reserve roll onto the ears 132, installs a new roll in the reserve roll holder 44 and threads toweling from the new reserve roll beneath the transfer arm 158 and the transfer fingers 160 as illustrated in FIG. 20.

While the transfer assembly 130 has been described in connection with a preferred feed mechanism, it should be understood that a transfer assembly embodying the invention can be used with conventional feed mechanisms which employ a feed roller and means for maintaining toweling in frictional engagement with the feed roller.

Figure 14:
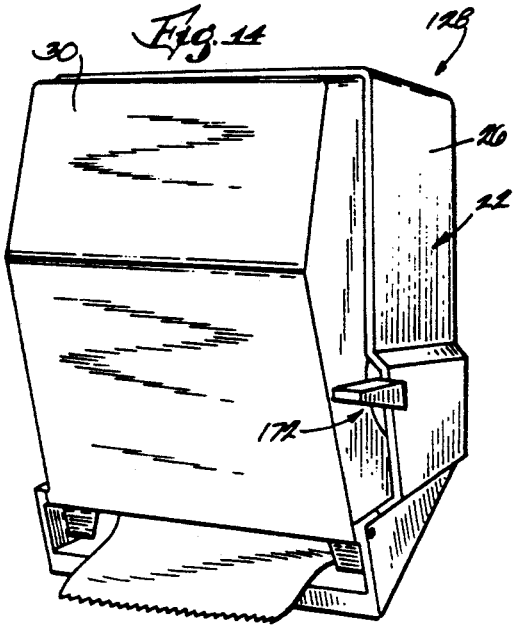
FIG. 14 is a perspective view of a paper towel dispensing cabinet embodying the invention for sequentially dispensing towelinq from a primary roll and a reserve roll and including a lever operator for dispensing toweling.

In the embodiment illustrated in FIGS. 14 and 19, the roller 60 is rotated by a lever assembly 172 including a gear 174 operably connected to one end of the roller 60 via a one-way clutch (not shown) and a lever arm 176. The gear 174 for lever operation is smaller than the gear 86 for crank operation. The lever arm 176 extends between a carriage side frame member 110 and the cabinet side wall 22 and includes a operating handle 178 and a planetary gear segment 180 which meshes with the roller gear 174. The end 182 of the lever arm 176 opposite to the operating handle 178 includes a pivot mount for pivotally mounting on the boss 122 on the carriage side frame member 110 and a spring 184 anchored between the lever arm 176 and a carriage side frame member 110 to bias the lever arm 176 upwardly. Full downward movement of the lever arm 176 rotates the roller 60 in a counterclockwise direction as viewed in FIG. 19 to dispense a predetermined length of paper toweling.

A dispenser can be converted from a crank operation to a lever operation by unsnapping and removing the outer part 94 of the crank unit 88 from the inner part 90 removing the carriage 108 from the cabinet 22, removing the inner part 90 of the crank unit 88 from the carriage boss 120, replacing the crank gear 86 on the roller 60 with a lever gear 174, mounting the lever arm 176 on the carriage boss 122 and replacing the carriage 108 in the cabinet.

The cabinet 122, carriage 108, cover 30, transfer assembly 130, gears 86 and 174, crank unit parts 90 and 94, ears 132 and lever arm 176 preferably are molded from a synthetic thermoplastic or thermosetting material. The cover 30 can be made from a transparent material so that an attendant can check to determine when it is time to install a new reserve roll without opening the cabinet.

The dispenser provided by the invention is simply constructed and can be made from an inexpensive, and yet durable, material for economical manufacture and assembly. The dispenser can be conveniently changed from a single roll to a two-roll dispenser, and vice versa, and from crank operation to lever operation, and vice versa, without the need for special tools. The dispenser is capable of accommodating different type and thickness sheet material, different size rolls and different size roll cores. It does not include an idler roller and, instead, employs a feed mechanism which employs a relatively small contact area between a primary drive drive ring and pressure finger. Such an arrangement minimizes jamming, resulting in a highly reliable operation, and permits convenient adjustment of the drive tension for different thickness and type material. When used as a two-roll dispenser, the simply constructed transfer assembly eliminates or at least minimizes the likelihood of a premature transfer from a primary roll P to a reserve roll R and reliably feeds material from the reserve roll R into the feed mechanism.

We claim:

1. A device for dispensing a flexible sheet material having inner and outer surfaces from a roll including a roll core having an outer surface, said device comprising a cabinet having a back portion, opposed side portions and a cover portion cooperating to define a storage compartment for at least one roll of sheet material, said cabinet including a dispensing opening through which the sheet material is dispensed;

holder means disposed in said storage compartment for supporting a roll of sheet material for rotation to permit the sheet material to be unwound from the roll; and a feed mechanism disposed in said storage compartment for receiving the sheet material from the roll and dispensing it through said dispensing opening, said feed mechanism including a drive roller rotatably supported in said cabinet and including a drive section having an outer surface, drive means for rotating said drive roller in one direction, a pressure element comprising a finger extending toward the drive section of said drive roller and having an end portion including a dispensing surface engageable with the inner surface of sheet material extending around a portion of said drive roller, and means for urging the dispensing surface of said finger toward engagement with the outer surface of said drive section so that, when sheet material extends between the dispensing surface of said finger and said drive section, the outer surface of said drive section is in sufficient frictional engagement with the sheet material to cause the sheet material to be unwound from the roll and advanced through said dispensing opening in response to operation of said drive means.

2. A device according to claim 1 wherein said finger has a first end portion including said dispensing surface, an opposite second end portion and an intermediate portion pivotally mounted for reciprocative movement of said first end portion away from and toward the outer surface of said drive section; and said biasing means comprises spring means operably connected to the second end portion of said finger to urge the dispensing surface of said finger into engagement with sheet material extending between the dispensing surface of said finger and said drive section.

3. A device according to claim 2 including means for adjusting the force applied on the second end portion of said finger by said spring means and thereby adjust the frictional force applied to the sheet material during rotation of said drive roller.

4. A device according to claim 1 wherein said cover portion has opposite sides and each side edge has an outwardly extending hinge post including a pivot portion and a D-shaped outer end portion and each of the side portions of said cabinet has a D-shaped opening for receiving a respective one of said posts for pivotal movement of said cover portion between open and closed positions and permitting withdrawal of said posts from said openings only when the D-shaped outer end portions of said posts are in registration with said openings.

5. A device according to claim 1 wherein said holder and said feed mechanism are supported on a separate carriage removably mounted in said cabinet.

6. A device according to claim 5 wherein said carriage includes first and second opposed side frame members adjacent the side portions of said cabinet and supporting said drive roller;

a front frame member connected between said side frame members and rotatably supporting said holder means for movement between a loading position wherein a portion of said holder means is located outside said storage compartment to facilitate installation and removal of a roll of sheet material onto and from said holder means and an operating position where the roll of sheet material is supported inside said storage compartment for dispensing;

a rear frame member connected between said side frame members; and a bottom wall substantially forming the bottom wall of said cabinet.

7. A device according to claim 6 wherein said drive means includes a first gear drivingly connected to one end of said drive roller adjacent one of the side frame members of said carriage;

a drive member mounted on said one side frame member of said carriage and carrying a second gear meshing with said first gear; and an operating handle connected to said drive member for moving said drive member rotate said drive roller.

8. A device according to claim 7 wherein said drive member comprises a crank unit including a first part rotatably mounted on said one side frame member of said carriage and carrying said second gear, said first part having a cup-like shape with an outwardly extending circular peripheral flange including a plurality of notches; and a second part carrying said handle and having a cup-like shape with an inwardly extending circular flange including a plurality of fingers which register with and snap into said notches in said first part to interconnect said first and second parts.

9. A device according to claim 7 wherein said drive member comprises a lever assembly including a lever arm having a first end portion including said handle, an intermediate portion including a planetary gear segment meshing with said first gear and an opposite second end portion mounted on said one side frame member of said carriage for pivotal movement of said lever between non-dispensing and dispensing positions; and spring means connected between said one side frame member of said carriage and said lever arm for returning said said lever arm from a dispensing position to the non-dispensing position.

10. A device according to claim 1 including first and second holder means for respectively supporting primary and reserve rolls of sheet material, each roll of sheet material including a roll core having an outer surface and the sheet material having inner and outer surfaces; and transfer means for transferring sheet material from the reserve roll to said feed mechanism when at least substantially all the sheet material has been dispensed from the primary roll, said transfer means including sensing means for sensing the thickness of both the sheet material on the primary roll and the roll core for the primary roll when material is being dispensed from the primary roll, and shifting means for transferring sheet material from the reserve roll to between the dispensing surface of said finger and the other surface of said drive section in response to said sensing mean sensing a thickness corresponding to the thickness of the roll core for the primary roll.

11. A device according to claim 10 wherein said transfer means comprises a transfer assembly including a first arm having a pair of transfer legs axially spaced relative to said drive roller and having transfer surfaces engageable with sheet material extending around a portion of said drive roller at locations on the opposite sides of the dispensing surface of said finger;

a second arm including a sensing surface engageable with the outer surface of sheet material on the primary roll and the outer surface of the roll core for the primary roll; and support means supporting said first and second arms for common movement between a non-transfer position where said sensing surface engages the outer surface of sheet material on the primary roll and said transfer surfaces are spaced away from the outer surface of said drive roller and a transfer position where said sensing surface engages the outer surface of the roll core for the primary roll and said transfer legs push sheet material from the reserve roll into engagement with the outer surface of aid drive section and, in response to rotation of said drive roller, causes the sheet material from the reserve roll to be fed between the dispensing surface of said finger and the outer surface of said drive section and advanced through said dispensing opening.

12. A device according to claim 11 wherein said first and second arms extend transversely relative to the side portions of said cabinet and have opposite ends connected together by web sections;

said support means includes pivot means supporting said web sections for pivotal movement of said first and second arms between the non-transfer and transfer positions;

said transfer assembly includes biasing means connected to one of said web sections for urging said first and second arms toward the transfer position; and said second arm includes a portion over which sheet material being unwound from the primary roll rides such that, when sheet material is being unwound from the primary roll in response to rotation of said drive roller, such sheet material urges said transfer assembly toward the non-transfer position.

13. A device according to claim 12 wherein said first and second holder means, said feed mechanism and said transfer assembly are supported on a separate carriage removably mounted in said cabinet.

14. A device according to claim 13 wherein said carriage includes first and second opposed side frame members adjacent the side portions of said cabinet and supporting said drive roller;

a front portion including a front frame member connected between said side frame members and rotatably supporting said second holder means for movement between a loading position where a portion of said second holder means is located outside said storage compartment to facilitate installation and removal of a reserve roll of sheet material onto and from said second holder means and an operating position where the reserve roll of sheet material is supported inside said storage compartment for dispensing;

a rear portion connected between said side frame members;

a bottom wall substantially forming the bottom wall of said cabinet; and wherein said first holder means includes a pair of ears mounted in the rear portion of said carriage adjacent said side frame members, said ears having inwardly extending bosses for receiving the opposite ends of a primary roll for rotation about an axis generally parallel to the rotational axis of said drive roller.

15. A device for sequentially dispensing paper toweling from primary and reserve rolls, each roll of toweling including a roll core having an outer surface and the toweling having inner and outer surfaces, said device comprising a cabinet having a back portion, opposed side portions and a cover portion cooperating to define a storage compartment for the primary and secondary rolls, said cabinet including a dispensing opening through which toweling is dispensed;

first and second holder means disposed in said storage compartment for respectively supporting the primary and reserve rolls of toweling for rotation to permit toweling to be unwound therefrom;

a feed mechanism disposed in said storage compartment for receiving toweling from either the primary roll or the reserve roll and dispensing it through said dispensing opening, said feed mechanism including a drive roller rotatably supported in said cabinet and including a drive section having an outer surface, drive means for rotating said drive roller in one direction, a pressure finger extending toward the drive section of said drive roller and having a first end portion including a dispensing surface engageable with toweling extending around a portion of said drive roller, an opposite second end portion and an intermediate portion pivotally mounted for reciprocative movement of said first end portion away from and toward the outer surface of said drive section, spring means operably connected to the second end portion of said pressure finger for urging said dispensing surface toward said drive section so that, when toweling extends between the dispensing surface of said pressure finger and said drive section, the outer surface of aid drive section is in sufficient frictional engagement when the toweling to cause the toweling to be unwound from the respective roll and advanced through said dispensing opening in response to operation of said drive means, a transfer assembly for transferring toweling from the reserve roll to said feed mechanism when at least substantially all the toweling has been dispensed from the primary roll, said transfer assembly including a transfer arm extending generally parallel to the rotational axis of said drive roller and having a pair of transfer legs axially spaced relative to said drive roller and including transfer surfaces engageable with toweling extending around a portion of said drive roller at locations on opposite sides of the dispensing surface of said pressure finger, a sensing arm connected to said transfer arm and including a sensing surface extending generally parallel to the rotational axis of the primary roll, and engageable with the outer surface of toweling on the primary roll and with the outer surface of the roll core of the primary roll, and means supporting said transfer arm and said sensing arm for common pivotal movement between a non-transfer position where said sensing surface engages the outer surface of toweling on the primary roll and said transfer surfaces are spaced from the outer surface of aid drive roller and a transfer position where said sensing surface engages the outer surface of the roll core for the primary roll and said transfer legs push toweling from the reserve roll into engagement with the outer surface of said drive roller and, in response to rotation of said drive roller, cause toweling from the reserve roll to be fed between the dispensing surface of said finger and the outer surface of said drive section and advanced through said dispensing opening.

16. A device according to claim 15 including means for adjusting the force applied on said second end portion of said pressure element by said spring means and thereby adjust the frictional force applied to toweling during rotation of said drive roller.

17. A device according to claim 16 wherein the transfer and sensing arms of said transfer assembly extend transversely relative to the side portions of said cabinet and have opposite ends connected together by web sections;

said support means includes pivot means mounting said web sections for pivotal movement of said transfer assembly arms between the non-transfer and transfer positions; and said transfer assembly includes biasing means connected to one of said web sections for urging said transfer assembly toward the transfer position.

18. A device according to claim 17 wherein said first and second holder means, said feed mechanism and said transfer assembly are mounted on a separate carriage removably mounted in said cabinet.

19. A device according to claim 18 wherein said carriage includes first and second opposed side members adjacent the side portions of said cabinet and rotatably supporting said drive roller;

a front portion including a front frame member connected between said side frame members and rotatably supporting said second holder means for movement between a loading position where a portion of said second holder means is located outside said storage compartment to facilitate installation and removal of a reserve roll of toweling onto and from said second holder means and an operating position where the reserve roll of toweling is supported inside said storage compartment for dispensing;

a rear portion connected between said side frame members; and a bottom wall substantially forming the bottom wall of said cabinet; and wherein said first holder means includes a pair of ears mounted in the rear portion of said carriage adjacent said side frame members, said ears having inwardly extending bosses for receiving the opposite ends of a primary roll for rotation about an axis generally parallel to the rotational axis of said drive roller.

20. A device for sequentially dispensing paper toweling from primary and reserve rolls, each roll including a roll core having an outer surface and the toweling having inner and outer surfaces, said device comprising a cabinet having a back portion, opposed side portions and a cover portion cooperating to define a storage compartment for the primary and secondary rolls, said cabinet including a dispensing opening through which toweling is dispensed;

first and second holder means disposed in said storage compartment for respectively supporting the primary and reserve rolls for rotation to permit toweling to be unwound therefrom;

a feed mechanism disposed in said storage compartment for receiving toweling from either roll and dispensing it through said dispensing opening, said feed mechanism including a drive roller rotatably supported in said cabinet and having an outer surface which frictionally engages the toweling and causes toweling to be unwound from the respective roll in response to said drive roller being rotated, means for rotating said drive roller and means for retaining the toweling in frictional engagement with the outer surface of said roller; and transfer means for transferring toweling from the reserve roll into said feed mechanism when at least substantially all the toweling has been dispensed from the primary roll, said transfer means including sensing means for sensing the net thickness of the toweling on the primary roll when toweling is being dispensed from the primary roll; and shifting means for transferring toweling from the reserve roll into frictional engagement with the outer surface of said drive roller in response to said sensing means sensing the absence of toweling on the roll core for the primary roll.

21. A device according to claim 20 wherein said transfer means comprises a transfer assembly including a first arm including at least one leg having a transfer surface engageable with toweling extending around a portion of said drive roller;

a second arm including a sensing surface engageable with the outer surface of toweling on the primary roll and with the roll core for the primary roll; and support means supporting said first and second arms for common movement between a non-transfer position where said sensing surface engages the outer surface of toweling on the primary roll and said transfer surface is spaced away from the outer surface of said drive roller and a transfer position where said sensing surface engages the outer surface of the roll core for the primary roll and said transfer surface pushes toweling from the reserve roll into frictional engagement with the outer surface of said drive roller and, in response to rotation of said drive roller, causes toweling from the reserve roll to be fed into said feed mechanism and advanced through said dispensing opening.

22. A device according to claim 21 wherein said first and second arms extend transversely relative to the side portions of said cabinet and have opposite ends connected together by web sections;

said support means includes pivot means supporting said web sections for pivotal movement of said first and second arms between the non-transfer and transfer positions;

said transfer assembly includes biasing means connected to one of said web sections for urging said first and second arms toward the transfer position; and said second arm includes a portion over which toweling being unwound from the primary roll rides such that, when the toweling is being unwound from the primary roll in response to rotation of said roller, the toweling urges said transfer assembly toward the non-transfer position.

23. A device for sequentially dispensing flexible sheet material having inner and outer surfaces from said first and second rolls, each roll including a roll core having an outer surface, said device comprising first and second holder means supporting respective first and second rolls of sheet material for rotation to permit the sheet material to be unwound from the respective roll core;

a feed mechanism for receiving and dispensing sheet material from either of said rolls including a rotatably mounted drive roller including a drive section having an outer surface;

a pressure element comprising a finger extending toward said drive section of said drive roller and having an end including a dispensing surface engageable with sheet material extending around a portion of said drive roller;

biasing means for urging the dispensing surface of said finger toward engagement with the outer surface of said drive section so that, when sheet material extends between the dispensing surface of said finger and said drive section, the outer surface of said drive section is in sufficient frictional engagement with the sheet material to cause the sheet material to be unwound from the respective roll and advanced through said dispensing opening in response to operation of said drive means; and transfer means for transferring sheet material from the second roll to said feed mechanism when at least substantially all the sheet material has been dispensed from the first roll, said transfer means including sensing means for sensing the thickness of both the sheet material on the first roll and the roll core for the first roll when sheet material is being dispensed from the first roll, and shifting means for transferring sheet material from the second roll to between the dispensing surface of said finger and the outer surface of said drive section in response to said sensing means sensing a thickness corresponding to the thickness of the roll core for the first roll.

24. A device according to claim 23 wherein said transfer means comprises a transfer assembly including a transfer arm having a pair of transfer legs axially spaced relative to said drive roller and having transfer surfaces engageable with sheet material extending around a portion of said drive roller at locations on the opposite sides of the dispensing surface of said finger;

a sensing arm connected to said transfer arm and including a sensing surface extending generally parallel to the rotational axis of the first roll and engageable with the outer surface of said sheet material on the first roll and with the outer surface of the roll core for the first roll; and support means supporting said transfer and sensing arms for common movement between a non-transfer position where said sensing surface engages the outer surface of sheet material on the first roll and said first surfaces are spaced away from the outer surface of said drive roller and a transfer position where said sensing surface engages the outer surface of the roll core for the first roll and said transfer legs push sheet material from the second roll into engagement with the outer surface of said drive section and, in response to rotation of aid drive roller, causes the sheet material from the second roll to be fed between the dispensing surface of said finger and said drive section of said roller and advanced for dispensing.

25. A device according to claim 24 wherein said transfer and sensing arms and have opposite ends connected together by web sections;

said support means includes pivot means supporting said web sections for pivotal movement of said transfer assembly between the non-transfer and transfer positions; and said transfer assembly includes biasing means connected to one of said web sections for urging said transfer assembly toward the transfer position.

* * * * *

UNITED STATES PATENT AND TRADEMARK OFFICE

CERTIFICATE OF CORRECTION

PATENT NO. : 5,294,192

DATED : March 15, 1994

INVENTOR(S) : Paul A. Omdoll et al.

It is certified that error appears in the above-identified patent and that said Letters Patent is hereby corrected as shown below:

Column 11, line 7, delete "sides" and insert ---side edges---.

Column 11, line 29, the word "wherein" should read ---where---.

Column 12, line 6, delete the second reference to the word "said".

Column 12, line 51, the word "aid" should read ---said---.

Column 14, line 8, the word "aid" should read ---said---.

Column 14, line 37, the word "aid" should read ---said---.

Column 17, line 24, after the word "of", delete "said".

Column 18, line 5, delete "first" and insert ---transfer---.

UNITED STATES PATENT AND TRADEMARK OFFICE

CERTIFICATE OF CORRECTION

PATENT NO. : 5,294,192

DATED : March 15, 1994

INVENTOR(S) : Paul A. Omdoll, et al

It is certified that error appears in the above-indentified patent and that said Letters Patent is hereby corrected as shown below:

Column 18, line 11, "aid" should read --said--.

Signed and Sealed this

Twenty-seventh Day of September, 1994

*Attest:*

Bruce Lehman

BRUCE LEHMAN

*Attesting Officer*

*Commissioner of Patents and Trademarks*